US008813980B1

(12) United States Patent
Billman

(10) Patent No.: US 8,813,980 B1
(45) Date of Patent: Aug. 26, 2014

(54) TWIN BEAM SHELF

(75) Inventor: Brian Lee Billman, Saginaw, MN (US)

(73) Assignee: Real Closet, Inc., Duluth, MN (US)

( * ) Notice: Subject to any disclaimer, the term of this patent is extended or adjusted under 35 U.S.C. 154(b) by 467 days.

(21) Appl. No.: 12/633,816

(22) Filed: Dec. 9, 2009

(51) Int. Cl.
*A47B 43/00* (2006.01)
*B27F 1/00* (2006.01)

(52) U.S. Cl.
USPC ..... 211/187; 144/347

(58) Field of Classification Search
USPC ..... 211/186, 188, 189, 194, 198, 90.01, 211/134, 119.003; 108/106, 107, 6, 157.16, 108/157.18, 155, 187, 158.12, 193, 109; 144/346, 347
See application file for complete search history.

(56) References Cited

U.S. PATENT DOCUMENTS 1,954,242 A * 4/1934 Heppenstall ..... 403/381
2,031,718 A 2/1936 Kress
2,065,133 A * 12/1936 Heppenstall ..... 108/185
2,708,292 A * 5/1955 Budai ..... 52/474
2,813,359 A * 11/1957 Ferdinand ..... 40/650
2,951,606 A * 9/1960 Benson ..... 217/65
3,042,978 A 7/1962 Eames et al.
3,186,363 A 6/1965 Moore
3,278,149 A * 10/1966 Brucker ..... 248/239
3,326,149 A * 6/1967 Mitchell et al. ..... 108/60
3,379,483 A * 4/1968 Oldford ..... 312/263
3,688,915 A 9/1972 Ramsey
3,899,228 A 8/1975 Schreiber
3,966,159 A 6/1976 Brown
4,077,333 A * 3/1978 Ballas ..... 108/6
4,125,338 A * 11/1978 Lew ..... 403/169
4,197,950 A 4/1980 Ovitz, III
4,329,003 A 5/1982 Manchester
4,372,516 A 2/1983 Nyquist
4,457,436 A 7/1984 Kelley
4,688,687 A 8/1987 Pryor
4,693,382 A 9/1987 Galen
4,720,016 A 1/1988 Kay
4,731,960 A 3/1988 Sease
4,792,195 A 12/1988 Adriaansen et al.
4,928,833 A 5/1990 Huizenga
4,995,323 A 2/1991 Kellems et al.
4,996,817 A * 3/1991 Nelson ..... 52/782.2
5,050,832 A 9/1991 Lee et al.
5,085,155 A * 2/1992 Ballard ..... 108/184
5,097,771 A 3/1992 James, III
5,127,340 A 7/1992 Maro et al.
5,203,639 A * 4/1993 Femrite ..... 403/382
5,222,611 A 6/1993 Wood et al.
5,322,173 A 6/1994 Kay
5,337,905 A 8/1994 Gast (Continued)

FOREIGN PATENT DOCUMENTS

DE 3047532 A * 7/1982 ..... A47B 47/00

*Primary Examiner* — Joshua Rodden
*Assistant Examiner* — Patrick Hawn
(74) *Attorney, Agent, or Firm* — Sherrill Law Offices, PLLC

(57) ABSTRACT

A twin beam shelf including a wood grain support structure defining a first major surface, a second major surface and longitudinally spaced front and rear edges with a rabbet extending along the front and rear edges. The front and rear wood grain beams are configured and arranged for cooperatively engaging the front and rear edges of the support structure to form a flush adhesive joint. The front and rear wood grain beams either extend laterally beyond the second major surface of the support structure or are flush with both surfaces of the support structure.

7 Claims, 6 Drawing Sheets

(56) References Cited

U.S. PATENT DOCUMENTS

| | | | | |
|---|---|---|---|---|
| 5,349,909 | A | 9/1994 | Smit et al. | |
| 5,392,934 | A | 2/1995 | Fox | |
| 5,439,123 | A | 8/1995 | Nook | |
| 5,467,562 | A | 11/1995 | Holland | |
| 5,582,306 | A | 12/1996 | Balter et al. | |
| 5,605,238 | A | 2/1997 | Jacobs | |
| 5,697,507 | A | 12/1997 | Blass | |
| 5,718,493 | A | 2/1998 | Nikolai | |
| 5,762,213 | A | 6/1998 | Heneveld, Sr. | |
| 5,813,737 | A | 9/1998 | Stone | |
| 5,819,958 | A | 10/1998 | Dement | |
| 5,908,119 | A | 6/1999 | Kump et al. | |
| 5,964,438 | A | 10/1999 | Camilleri | |
| 6,129,222 | A | 10/2000 | Mylander et al. | |
| 6,183,585 | B1 * | 2/2001 | Kelley | 156/182 |
| 6,209,976 | B1 | 4/2001 | Shear | |
| 6,374,547 | B1 | 4/2002 | Baloga et al. | |
| 6,786,337 | B2 | 9/2004 | Klein et al. | |
| 6,800,353 | B1 * | 10/2004 | Anderson et al. | 428/141 |
| 6,915,913 | B2 | 7/2005 | Cardinell | |
| 6,988,628 | B2 | 1/2006 | Krieger et al. | |
| 7,255,237 | B2 | 8/2007 | Stitchick et al. | |
| 7,314,144 | B2 | 1/2008 | Stitchick et al. | |
| 7,392,911 | B2 | 7/2008 | Stitchick et al. | |
| 2002/0104813 | A1 | 8/2002 | Routhier | |
| 2004/0157056 | A1 | 8/2004 | Ourth | |
| 2004/0263030 | A1 | 12/2004 | Humberto | |
| 2005/0184630 | A1 | 8/2005 | Bonanno et al. | |
| 2006/0091271 | A1 | 5/2006 | Nowak | |
| 2006/0243688 | A1 | 11/2006 | Gilcrest et al. | |
| 2008/0001511 | A1 | 1/2008 | Amlang et al. | |
| 2008/0010935 | A1 | 1/2008 | Nagel et al. | |
| 2008/0224579 | A1 | 9/2008 | Justen | |
| 2010/0116762 | A1 | 5/2010 | Piersant et al. | |

* cited by examiner

TWIN BEAM SHELF

BACKGROUND

Closet shelving systems have been manufactured and installed in residential and commercial buildings for storage of personal or commercial items. The size, strength and versatility of the closet shelving systems are of particular concern with any new or existing installation. The closed shelving system should be aesthetically pleasing while maintaining the desired functionality sought by the user. With storage space at a premium efficient use of shelving space is a must along with the ability to quickly and easily change the configuration or layout of the shelves with minimum need for tear down and reconstruction of the entire system.

U.S. Pat. No. 5,322,173 to Kay describes a ventilated wooden shelf with cylindrical stubs attaching each separate flat shelf member to holes cut into support beams.

U.S. patent application Ser. No. 11/039,715 describes a storage system configured with support brackets which fit into pre cut cavities of opposing walls.

U.S. patent application Ser. No. 11/407,710 describes a modular storage system with rails secured to a wall and the storage units that hang over the rails flush against the wall.

In the prior art, closet shelves are constructed from plastic coated wire, partitioned wood sections or plastic and wood combinations. The size, strength and flexibility of the shelves are determined from their particular structure. However, such designs are limited in construction size and weight bearing load and are difficult to change the layout once constructed. Therefore, a need exists for a versatile shelf with greater weight supporting capacity and versatility at greater shelf lengths.

SUMMARY OF THE INVENTION

A twin beam shelf, comprising wood grain support structure defining a first major surface, a second major surface and longitudinally spaced front and rear edges with a rabbet extending along the front and rear edges. The front and rear wood grain beams are configured and arranged for cooperatively engaging the front and rear edges of the support structure to form a flush adhesive joint. The front and rear wood grain beams extend laterally beyond the second major surface of the support structure.

DETAILED DESCRIPTION OF A PREFERRED EMBODIMENT

Nomenclature

Figure 1:
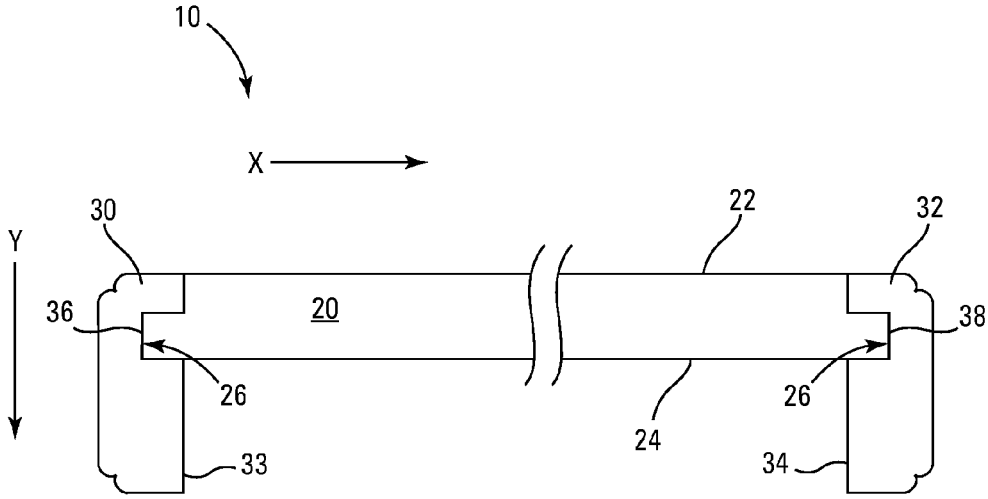
FIG. 1 is a side perspective view of first embodiment of the present claimed invention the twin beam shelf with extending lateral lips.

10 Twin Beam Shelf
20 Support Structure
22 First Major Surface
23 Rear Edge
24 Second Major Surface
25 Front Edge
26 Adhesive Joint
30 Rear Beam
32 Front Beam
33 Rear Lip
34 Front Lip
36 Front Dado
38 Rear Dado
50 Set of Wall Anchors
51 Bottom Wall Anchor
52 Top Wall Anchor
53 Recess
60 Set of Keyway Supports
61 Bottom Keyway Support
62 Top Keyway Support
70 Upright Support
90 Clips
200 Wall
x Longitudinal Direction
y Lateral Direction Construction The present claimed invention is directed to a twin beam shelf 10 comprising a wood grain support structure 20 with front and rear beams or molding 32, 30 secured to the front and rear edges 25, 23 of the support structure 20 by an adhesive and forming front and rear lips 34, 33. The twin beam shelf 10 uses include, but are not limited to, cabinetry, shelving, closets, home organizational systems, pantries or garage storage units.

Residential or commercial standard shelving has traditionally been particle board with a plastic edge band which covers the cut edge of the flat shelving surface or a wire constructed shelf and support. Prior industry standards have been plagued by limited shelving strength, limited or cumbersome adjustments if needed and poor aesthetic qualities. Most industry standard shelves have a limited edge to edge length of 30 inches with one flat surface for storage.

Figure 2:
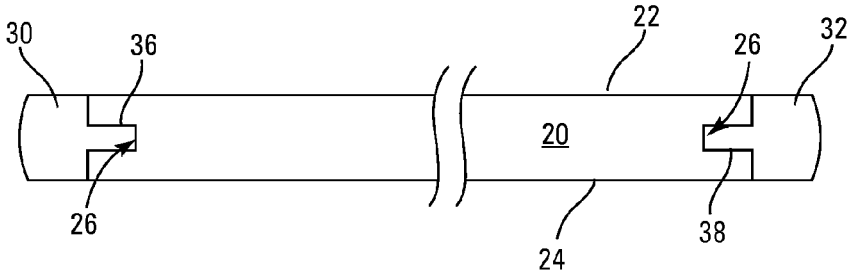
FIG. 2 is a side perspective view of the second embodiment of the present claimed invention the twin beam shelf without the laterally extending lips.
Figure 3:
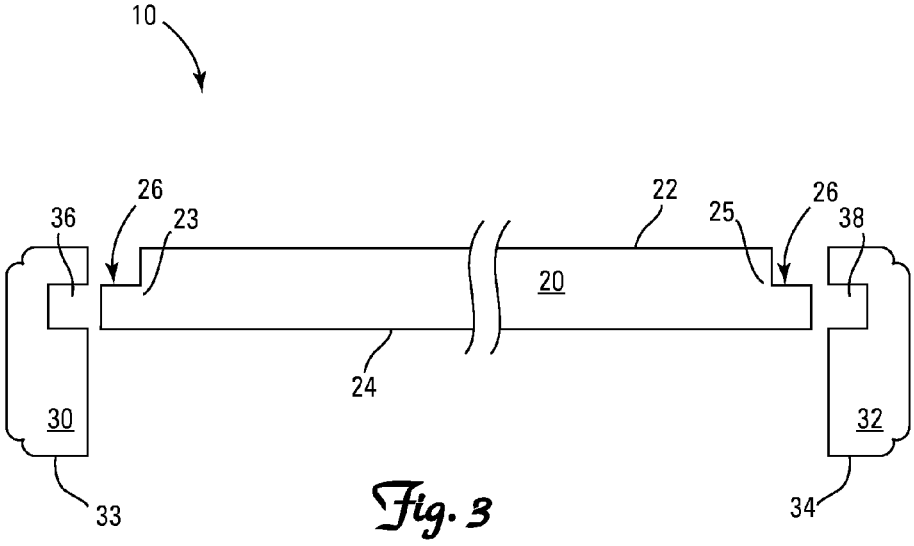
FIG. 3 is an exploded side perspective view of the first embodiment of the present claimed invention.

Referring to FIGS. 1-3, the twin beam shelf 10 has a dual wood or hybrid wood construction. Both the support structure 20 and the front and rear beams 32, 30 are a wood grain material including, but not limited to particle board, plywood or hardwood. The hardwood would include maple, oak, poplar, cherry, ash, walnut, hickory, mahogany, alder, aspen, basswood or beech. The twin beam shelf 10 consists entirely of wood grain materials which is preferable for cutting and fitting during installation. In addition, the dual wood construction is available for a finished wood appearance. The support structure 20 and beams 30, 32 may be stained to a desired color allowing for unique shelving designs. When the support structure 20 of the twin beam shelf 10 is plywood or particle board a wood grain melamine laminate print may be used to represent a stained hardwood finish. The front and rear beams 32, 30 which may be a hardwood when the support structure 20 is plywood or particle board, may have a commercially available ultra violet waterborne finish to match the coloring of the support structure 20.

Referring to FIG. 3, one embodiment of the twin beam shelf 10 includes front and rear rabbet cut edges 25, 23 of the support structure 20 spaced in the longitudinal direction x. Front and rear beams 32, 30 have front and rear dados 36, 38 defined as a rectangular grooves cut into the beams 32, 30 respectfully. The front and rear rabbet cut edges 25, 23 cooperatively engage the front and rear dados 36, 38 forming a four sided adhesive joint 26. An adhesive, such as wood glue, covers the four flush surfaces of the adhesive joint 26 securing the front and rear beams 32, 30 to the support structure 20. The four sided adhesive joint 26 extends the length of the support structure 20 greatly increasing the strength and shelf weight. A twin beam shelf 10 may extend approximately 60 inches in length, as opposed to the industry standard 30 inches, without intermittent bracing or underneath supports and without losing significant support strength. Because the twin beam shelf 10 is made of all wood grain material the size may be cut to fit any desired space greatly increasing the room for storage.

The present invention in FIG. 1 depicts the front and rear beams 32, 30 extending in the lateral direction y below the second major surface 24 of the support structure 20 forming front and rear lips 34, 33. One example of the dimensions of the twin beam shelf 10 depicted in the FIG. 1 include a length of up to 60 inches, a shelf width in the longitudinal direction x of approximately 6-16 inches and an approximate 0.5-1 inch front and rear lip 34, 30 laterally extending from the second major surface 24 of the support surface 20. Longer shelving lengths ranging up to 60 inches are available and are proportional to the increased thickness and width of the support surface 20. The approximate measurements of the particular characteristics of the twin beam shelf 10 are dependent on the accuracy of the wood cuts and the saws used to make such cuts. These measurements are approximate and may be modified to fit a particular application or design.

A second embodiment in FIG. 2 depicts the support structure 20 with the front and rear wooden beams 32, 30 that do not extend laterally below the second major surface 24 but are flush with the first and second major surfaces 22, 24 of the support structure 20. The edges 25, 23 of the support structure 20 have a multiple side adhesive joint 26 cooperatively engaging the beams 32, 30. This shelf 10 without lateral lips of the first embodiment still offers the increased support strength compared to the industry standard shelves and allows the edge to edge length to extend at least 60 inches with minimal loss of strength.

Figure 4:
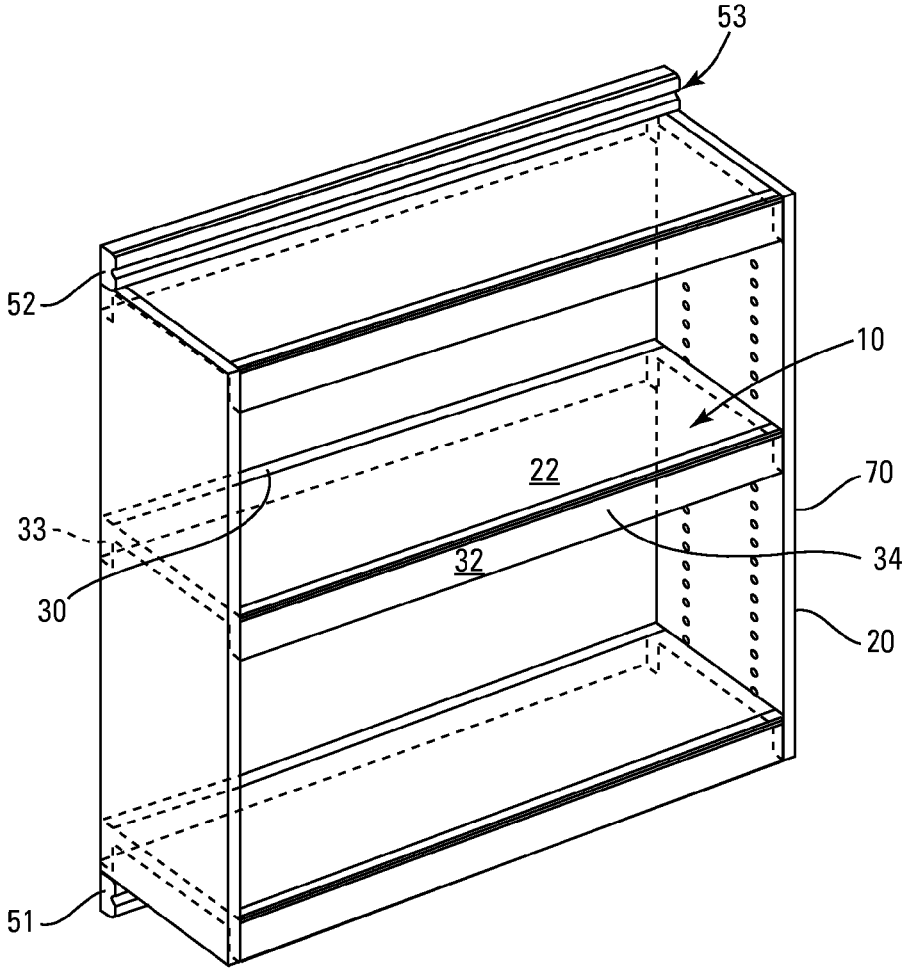
FIG. 4 is a first mounting configuration with lips of the twin beam shelf extending in a downward direction.
Figure 5:
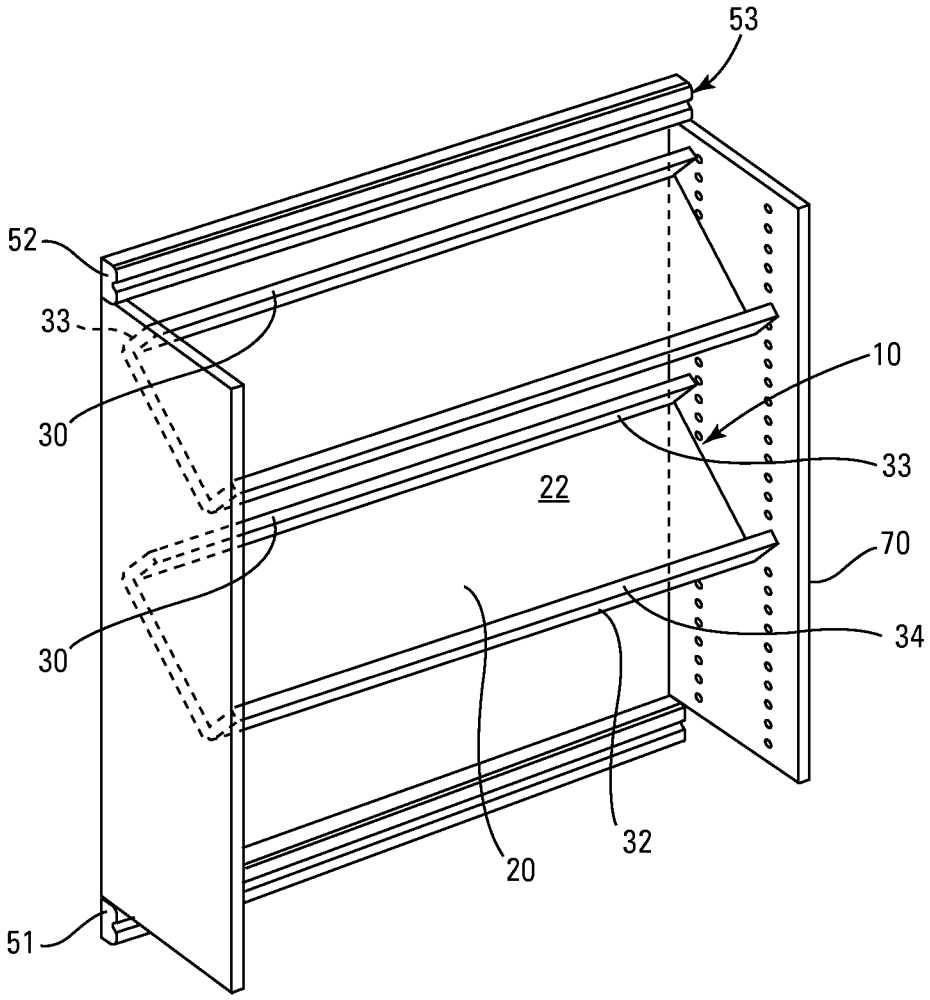
FIG. 5 is a second mounting configuration with lips extending in an upward direction and the twin beam shelf mounted at an angle.
Figure 6:
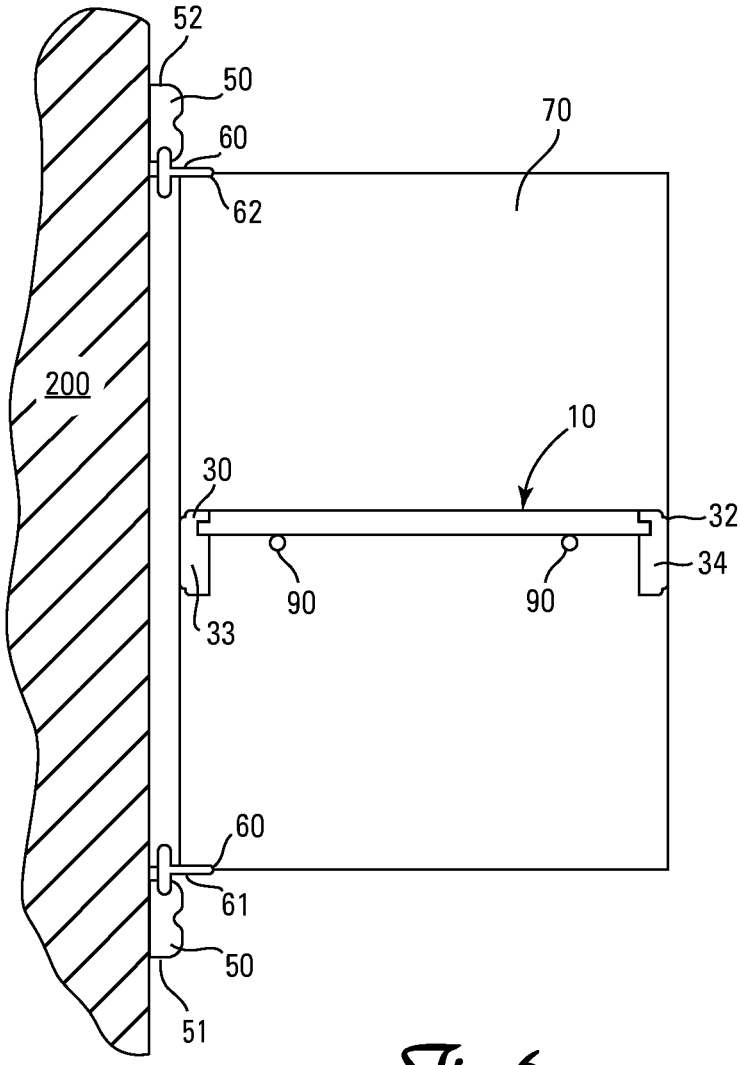
FIG. 6 is a side view of the first mounting configuration of the first embodiment.
Figure 7:
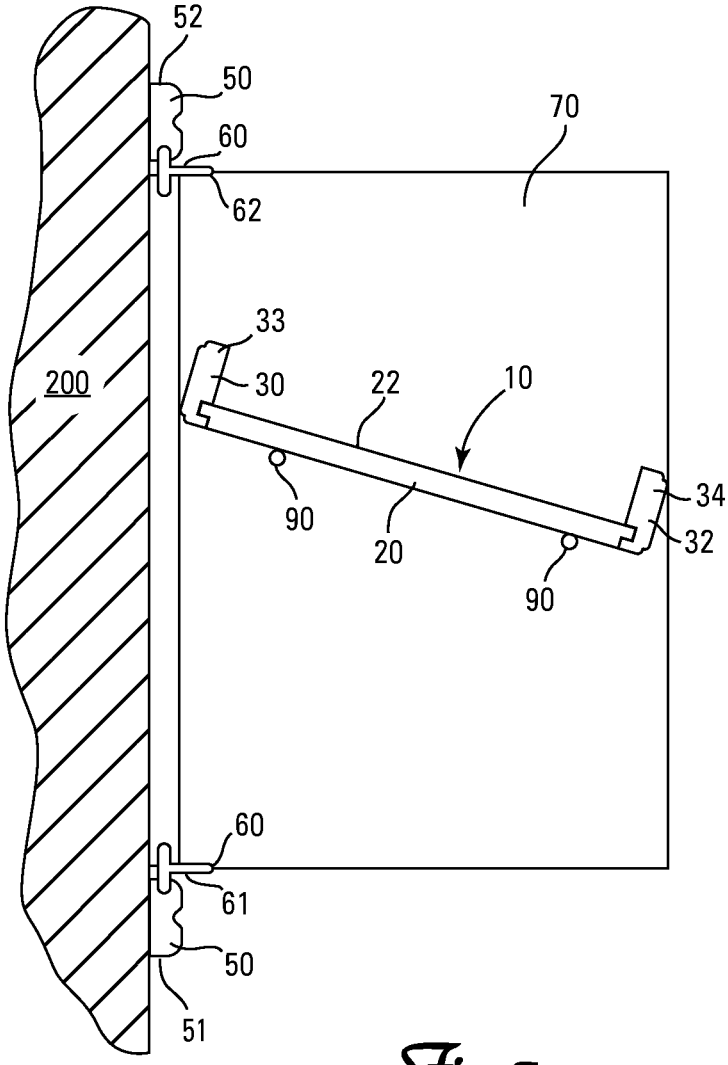
FIG. 7 is a side view of the second mounting configuration of the first embodiment.

Depicted in FIGS. 4-7 are separate mounting assemblies for the twin beam shelf 10. Including, as depicted in FIGS. 6-7, a set of wall anchors 50 that are secured to the wall 200, a set of opposing upright supports 70 and a set of keyway supports 60 including top and bottom keyway supports 62, 61 to secure the upright support 70 to the wall 200. A bottom wall anchor 51 is secured at a user determined distance off the ground. The top wall anchor 52 is spaced an approximate vertical distance from the bottom wall anchor 51 and secured to the wall 200. The top and bottom wall anchors 52, 51 with a recess 53 running the length of each wall anchor 52, 51 may extend flush against the support wall 200 for the entire desired length of the twin beam shelf 10.

Use

Referring to FIGS. 4 and 6 depict a first mounting configuration of the twin beam shelf 10 with front and rear lips 34, 33 which extend laterally from the second major surface 24 of the support structure 20. The lips 34, 33 are pointed in the downward direction. Standard shelf clips 90 are secured in a place that support the twin beam shelf 10 and additional weight from objects place on the shelf 10. The twin beam shelf 10 exposes the flat first major surface 22 from front to rear of the support structure 20 for placement of various objects.

Referring to FIGS. 5 and 7, in a second mounting configuration the twin beam shelf 10 may be flipped over so the front and rear lips 34, 33 are pointed upward. There is no need to install additional railings since the upwardly extending lips 33, 34 may then be used as guard rails. When the twin beam shelf 10 is mounted at a downwardly angle the front and rear lips 34, 33 act as a barrier to prevent objects from sliding off the support structure 20. The angled twin beam shelf 10 may be used as a display rack for plaques, magazines or books while still maintaining its support strength. Additionally, the angling of the twin beam shelf 10 may be used to store and display shoes within a closet. There is no need to add an additional rail or guard rail because the twin beam shelf 10 has the front lip 34 inherently acts as a guardrail.

The twin beam shelf 10 may be mounted on clips 90 as depicted in FIGS. 6-7. The twin beam shelf 10 may be assembled to the upright supports by common industry shelving clips 90 or pegs such as those manufactured by Hafele Company among others. Since the twin beam shelf is made entirely of a wood grain material additional holes may be drilled to the twin beam shelf 10 to accommodate mounting with a variety of clamps available in the shelving or woodworking industry. The user has the option of mounting the twin beam shelf 10 in either configuration and has the flexibility to change shelving configuration without additional, loose tools or parts.

The second embodiment of the claimed invention the shelf 10 does not have lips extending laterally. However, in the second embodiment still has the increased strength provided by the twin beam construction described previously. The twin beam shelf 10 still may be flipped over and readjusted without the addition of tools or loose parts. Both the first and second surfaces 22, 24 of the support structure 20 will support objects. If one major surface gets scratched or damaged the twin beam shelf 10 may be flipped over to hide the damage and display the undamaged surface.

I claim:

1. A shelving system, comprising:

(a) right and left mirror image side panels, each having a first inside surface with shelving peg holes, (b) a plurality of shelf support pegs configured and arranged for selective and releasable engagement within the shelving peg holes, (c) at least one shelf configured and arranged for gravitational support between the side panels upon the shelf support pegs extending from the side panels so as to present an upward load contacting surface and a forward facing visible ornamental surface, the shelf including (i) a wood grain planar support structure defining a first major surface, a second major surface, a transversely extending length, longitudinally spaced first and second edges, and transversely spaced first and second ends, with a rabbet extending transversely along the first and second edges, and (ii) first and second transversely extending wood grain beams attached to the first and second edges of the support structure, each with a first transversely extending margin flush with the first major surface of the planar support structure so as to form a completely and continuously flat shelving surface with the first major surface of the support structure, and a second transversely extending margin which extends laterally beyond the second major surface of the support structure so as to form a raised lip shelving surface with the second major surface of the support structure, (d) wherein, the shelving system is configured such that, when assembled into an upright shelving unit, the shelf may be selectively and stably supported between the side panels and upon the shelf support pegs in any one of several configurations without repositioning of the shelf support pegs on the side panels; the configurations including at least (A) wherein the shelf flat shelving surface is facing upward with the first beam providing the forward facing visible ornamental surface, and (B) wherein the shelf flat shelving surface is facing downward such that the shelf presents a tray appearance with the first beam providing the forward facing visible ornamental surface.

2. The shelving system in claim 1 wherein the wood grain includes hardwood, plywood, or particle board.

3. The shelving system in claim 1 wherein the transverse length of the shelf ranges from 30 inches-60 inches.

4. The shelving system in claim 1 wherein the first and second beams are adhesively attached to the support structure at front and rear rabbet joints.

5. The shelving system in claim 1 wherein the first and second beams have an ultra violet waterborne finish.

6. The shelving system in claim 4 wherein each rabbit joint has four flush surfaces with adhesive applied.

7. The shelving system of claim 1 wherein the first and second beams each have a dado for cooperatively engaging the rabbet of the first and second edges of the support structure.

* * * * *